US007326029B2

(12) United States Patent
Ahlroth et al.

(10) Patent No.: US 7,326,029 B2
(45) Date of Patent: Feb. 5, 2008

(54) CENTRIFUGAL PUMP AND AN IMPELLER THEREOF

(75) Inventors: Jussi Ahlroth, Jämsä (FI); Heikki Manninen, Vilppula (FI)

(73) Assignee: Sulzer Pumpen AG, Winterthur (CH)

( * ) Notice: Subject to any disclaimer, the term of this patent is extended or adjusted under 35 U.S.C. 154(b) by 0 days.

(21) Appl. No.: 11/413,959

(22) Filed: Apr. 28, 2006

(65) Prior Publication Data

US 2006/0263200 A1 Nov. 23, 2006

(30) Foreign Application Priority Data

Apr. 29, 2005 (FI) ..... 20050450

(51) Int. Cl.
*F01D 3/04* (2006.01)

(52) U.S. Cl. ..... 415/106; 415/104

(58) Field of Classification Search ..... 415/54.1, 415/58.1, 106, 104

See application file for complete search history.

(56) References Cited

U.S. PATENT DOCUMENTS 1,180,587 A * 4/1916 Ingram ..... 415/106
5,061,151 A 10/1991 Steiger
5,209,652 A 5/1993 Fischer et al.
5,224,821 A * 7/1993 Ozawa ..... 415/169.1

* cited by examiner

*Primary Examiner*—Edward K. Look
*Assistant Examiner*—Dwayne J White
(74) *Attorney, Agent, or Firm*—Townsend and Townsend and Crew LLP

(57) ABSTRACT

The present invention relates to a centrifugal pump and an impeller thereof. The present invention especially relates to modifying an impeller of a centrifugal pump in such a way that the pump may be used without a risk of damaging a shaft seal or the like at capacities higher than that at the optimal operating point. A characterizing feature of a centrifugal pump, comprising a pump volute (2), a rear wall (4) of the pump, an impeller (20) having a shroud (22) and balancing holes extending through the shroud, the impeller being attached on the pump shaft (6) and rotating inside the volute (2), is that the balancing holes (26) are arranged through the shroud (22) in such a way that an opening (30) of the holes (26) in the front face of the impeller shroud (22) is both in the rotational direction and ahead of an opening (32) located in the rear face of the impeller shroud (22) and closer to the axis (8) of the pump than the opening (32) in the rear face of the impeller shroud (22).

10 Claims, 3 Drawing Sheets

CENTRIFUGAL PUMP AND AN IMPELLER THEREOF

BACKGROUND OF THE INVENTION

The present invention relates to a centrifugal pump and an impeller thereof. The present invention especially relates to modifying an impeller of a centrifugal pump in such a way that the pump may be used without a risk of damaging a shaft seal or the like at capacities higher than that of the optimal operating point.

It is already known that when pumping liquid or a suspension by a centrifugal pump, liquid is entrained into a space behind the impeller of the centrifugal pump when working vanes of the impeller increase the pressure of the liquid in front of the impeller. Thereby, the liquid to be pumped in addition to being discharged through the pressure opening of the pump to the pressure conduit also tends to fill the space behind the impeller with a pressurized liquid. Although the liquid between the impeller and the rear wall of the pump rotates, on the average, half the speed of the impeller (provided that there are no so-called rear vanes or like ribs on the impeller shroud) and thus, while generating centrifugal force, reduces to a certain extent the pressure prevailing in the sealing space behind the impeller in the area of the shaft of the pump, a considerable pressure, however, as one would expect affects also the shaft seals in connection with the rear wall of the pump or behind it. Partially, therefore, so-called rear vanes have been arranged on the rear face of the impeller shroud, which rear vanes pump the liquid having entered the space outwards, whereby the pressure in the space behind the impeller substantially decreases.

The rear vanes must, however, be dimensioned so that they operate optimally only in a certain capacity range of the pump, whereby deviation in either direction from the capacity range results in that the pressure prevailing within the area of the rear vanes and also in the seal space changes. If the output of the pump is increased, the rear vanes generate, in the worst scenario, a negative pressure, which can, at its worst, also make the liquid in the seal space boil, especially when pumping liquids at a higher temperature. Correspondingly, when decreasing the capacity, for example, by constricting such by a valve, the pressure behind the impeller increases and the stresses increase. At the same time, as one would expect, the stress on the bearings also increases.

For a corresponding purpose, i.e. for balancing the pressure prevailing on the different sides of the impeller, it is also suggested that balancing holes be used, which are holes parallel to the axis of the pump made in the impeller shroud close to the hub of the impeller, through which the liquid from the side of the impeller where the pressure is higher is allowed to be discharged to the area of the lower pressure. In other words, the flow in the balancing holes may be in either direction.

However, although both balancing methods are in use, it has been noticed that when moving along a so-called pump curve in the H, Q (head, capacity) chart, i.e. to the right in the direction of higher capacity, the balancing in accordance with the prior art is not always capable of sufficiently preventing the pressure in the sealing space from dropping below the pressure prevailing in front of the impeller of the pump. This is problematic because the negative pressure in the sealing space leads to the fact that the lubricating effect of the liquid to be pumped or other liquid on seals decreases when the liquid escapes from the seals. Depending on the seal type, the escaping of the liquid from the seal may cause the seal to run dry, which with some seal types can very quickly lead to a damaged seal.

Another seal type to be used in the centrifugal pumps is a so-called dynamic seal, the operation of which is based on the operation of a rotor rotating in a separate chamber behind the rear wall of the pump. In favorable pressure conditions, the rotor comprising a substantially radial disc and vanes arranged on the rear surface thereof relative to the impeller of the pump rotates a liquid ring in the chamber in such a way that the liquid ring seals the space between the disc and the wall of the chamber, sealing at the same time the pump itself. If such a rotary liquid ring is subjected to a pressure difference high enough, the liquid ring will escape towards the lower pressure. If a pressure lower than that of the atmosphere is generated behind the impeller of the pump, it tends to draw the liquid ring out of the seal chamber. If this takes place, air is allowed to flow without problems from behind the pump into the pump. Air can also flow in a corresponding manner through the mechanical shaft sealing of the pump into the pump. The effect of the leaking of air on the pumping itself is that air, at its worst, stops the pumping.

SUMMARY OF THE INVENTION

The present invention tends to eliminate at least some of the above-described problems and disadvantages of the centrifugal pumps in accordance with the prior art by introducing a new kind of an impeller, in which the balancing holes are located in the impeller shroud in such a manner that the openings of the hole in the front face of the shroud are both in the rotational direction of the impeller in ahead of an opening located in the rear face of the shroud and closer to the axis of the pump than the opening in the rear face of the impeller shroud.

Other features characteristic of the invention become apparent from the accompanying claims.

BRIEF DESCRIPTION OF THE DRAWINGS

The invention is discussed below by way of example with reference to the accompanying drawings, in which FIG. 1 schematically illustrates an impeller in accordance with the prior art, clearly showing an axial balancing hole.

DESCRIPTION OF THE PREFERRED EMBODIMENTS

Figure 1:
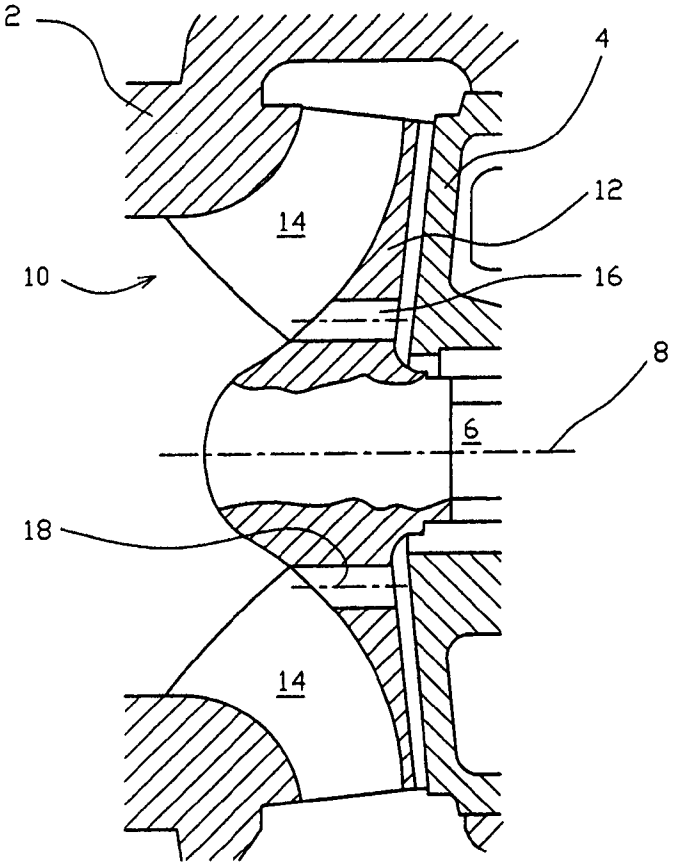

FIG. 1 schematically illustrates a conventional structure of an impeller 10 of a centrifugal pump in accordance with the prior art. The figure also illustrates pump components, such as a pump volute 2, a rear wall 4 of the pump and a pump shaft 6 with an axis 8. The impeller 10 comprises a shroud 12 with working vanes 14, balancing holes 16 and possible rear vanes. It is a characteristic feature of the balancing holes in accordance with prior art that the centerline 18 thereof is parallel to the axis 8 of the pump. Moreover, the balancing holes 16 have been brought relatively close to the axis 8 of the pump and located at the pressure face of the working vane. The pressure face of the vane refers to the convex side of the vane, i.e. the face against which the liquid to be pumped when being pumped is pressed and along which the liquid to be pumped flows towards the pressure opening. Correspondingly, the negative pressure face of the vane refers to the concave side of the vane, where a low-pressure area is generated when the impeller rotates because of the inertia of the liquid to be pumped and the centrifugal force. The purpose of the above-described positioning of the holes is to ensure that part of the liquid flow goes through the hole to the rear side of the impeller 10 to raise the pressure of the sealing space S.

Figure 2:
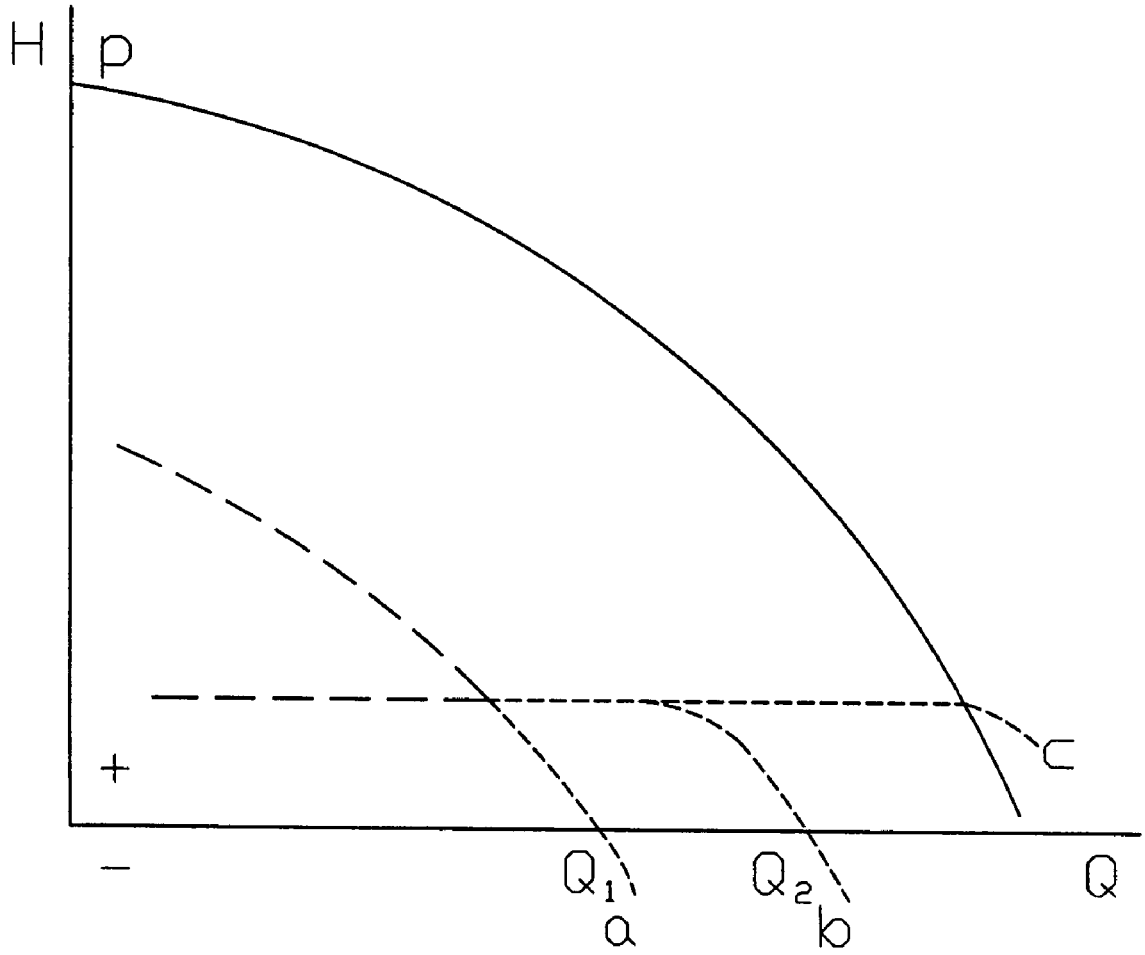
FIG. 2 illustrates a pump curve and a pressure curve of a sealing space with various impeller alternatives drawn in the H, Q chart.

FIG. 2 illustrates both the capacity curve of the centrifugal pump and the pressure prevailing in the sealing space S thereof, when three different impellers are tested in the pump, all in the same H, Q (head, capacity) chart. An evenly descending curve illustrated with a continuous line shows the head of the pump with different capacities. Broken lines a-c schematically illustrate the pressure change in the sealing space of the pump as a function of the pump capacity. The horizontal axis illustrates, in addition to the zero value of the head of the pump, also the atmospheric pressure, whereby a pressure higher than that of the atmosphere prevails in the area above the horizontal axis and a pressure lower than that of the atmosphere in the area below the horizontal axis.

The curve a of FIG. 2 illustrates a situation where there are no balancing holes at all in the impeller shroud of the pump. Thereby, the pressure in the sealing space decreases to a negative value already with low volume flow Q1. Thereby, the above-mentioned damage or leakage situations may take place. The situation illustrated in the drawing means that it would not be safe to use the pump with volume flows higher than volume flow Q1, in other words not even nearly over its entire hydraulic capacity range. To correct the situation of curve a, straight axial balancing holes are arranged through the impeller shroud resulting in curve b, which crosses the horizontal axis at volume flow Q2, in other words by a capacity significantly higher than volume flow Q1. In other words, a pump provided with rear vanes and axial balancing holes in accordance with the prior art may be safely used in those applications where the volume flow Q2 remains on the left, in other words on the lower side. Since there is a lot of hydraulic capacity of the pump left, it would be reasonable to be able to increase the capacity from the volume flow Q2 upwards. It cannot, however, be carried out by using the prior art structures, because in such a case the pressure of the sealing space of the pump would reduce below the atmospheric pressure and the risk of the pump seals running dry, or the dynamic seals leaking, would be too high.

Curve c in FIG. 2 illustrates an advantage being gained by using the impeller in accordance with the invention. Curve c continues substantially horizontally up to the maximal capacity of the pump, whereby according to curve c the pressure of the sealing space remains positive throughout the entire capacity range of the pump, and there is no or hardly any risk of the seal running dry resulting in seal damage or the air leakage in the dynamic seal of the pump.

Figure 3:
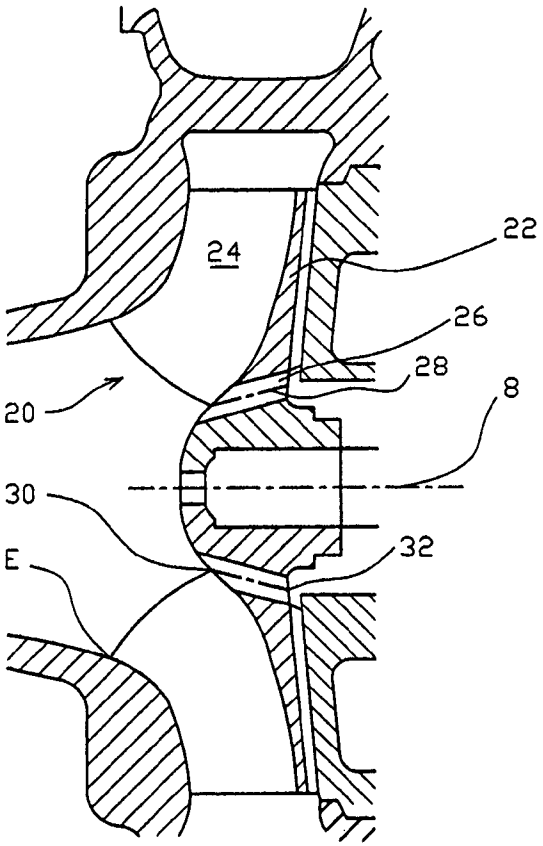
Fig. 3 PRIOR ART
FIG. 3 schematically illustrates an axial view of an impeller in accordance with a preferred embodiment of the invention with inclined balancing holes, the view having also been partially sectioned along the centerline of the balancing holes.

FIG. 3 illustrates a solution, by means of which results given by curve c in FIG. 2 are gained. The solution comprises an impeller 20 of a centrifugal pump in accordance with a preferred embodiment of the invention with an impeller shroud 22, working vanes 24, and possible rear vanes, and also with axis 8 of both the pump and an impeller. What is new in the structure in FIG. 3 is the balancing holes 26, the direction of the centerline 28 of which deviates from the axis 8 of the pump. In the embodiment shown in the drawing FIG. 3, the sectional view is taken along the centerline 28 of the holes 26. Thus it is clear that although FIG. 3 might give the idea that the holes are situated in an axial plane, the holes 26 are in reality inclined. In other words, they have been deviated from the axial plane radially as well as circumferentially. It is a characteristic feature of both the centerline 28 of the balancing holes 26 and the balancing holes 26 in accordance with this embodiment themselves that an opening 30 on the side of the impeller shroud facing the suction conduit of the pump (left in the drawing) is closer to the axis 8 of the pump (i.e. on a smaller diameter) than the opening 32 behind the impeller shroud, i.e. at the opposite end of the balancing hole. The performed tests show that the closer to the axis 8 of the impeller the inlet openings of the holes 26 come, the better the holes function as balancing holes in their planned purpose. In practice, there is almost always a central opening for the shaft of the pump extending through the hub of the impeller in the center of the impeller, preventing the openings 30 of the balancing holes on the side of the suction conduit of the pump from extending as far as to the axis 8 of the pump. Thus, the openings are brought as close to the opening for the pump shaft as possible. It is thus an essential feature of the invention that the openings 30 in the impeller shroud on the side facing the suction conduit of the pump are located inside the circle of revolution formed by the radially inner tip E of the free edge (the edge opposite the impeller shroud 22, i.e. the edge facing the pump casing). This circle corresponds in its diameter most often to the diameter of the suction conduit of the pump. The openings 30 are preferably located at or near to the area of the leading edge of the working vane, more precisely, for example, to such a circle on the impeller shroud 22 that the working vanes 24 start from. More preferably, the openings 30 could be located even closer to the axis 8, if the rest of the structure (for example, the opening for the shaft or the attachment nut of the impeller) only allows it. It is characteristic of the invention that the holes 26 are partially directed circumferentially so that the direction thereof is along the impeller vane passage, i.e. along the cavity between the working vanes, i.e. in the flow direction of the liquid. In other words, the openings 32 of the balancing holes in the rear face of the impeller shroud are located in the rotational direction of the impeller behind the opening 30 at the opposite end of the balancing hole 26, i.e. in the front face of the impeller shroud and also radially outside thereof.

Figure 4:
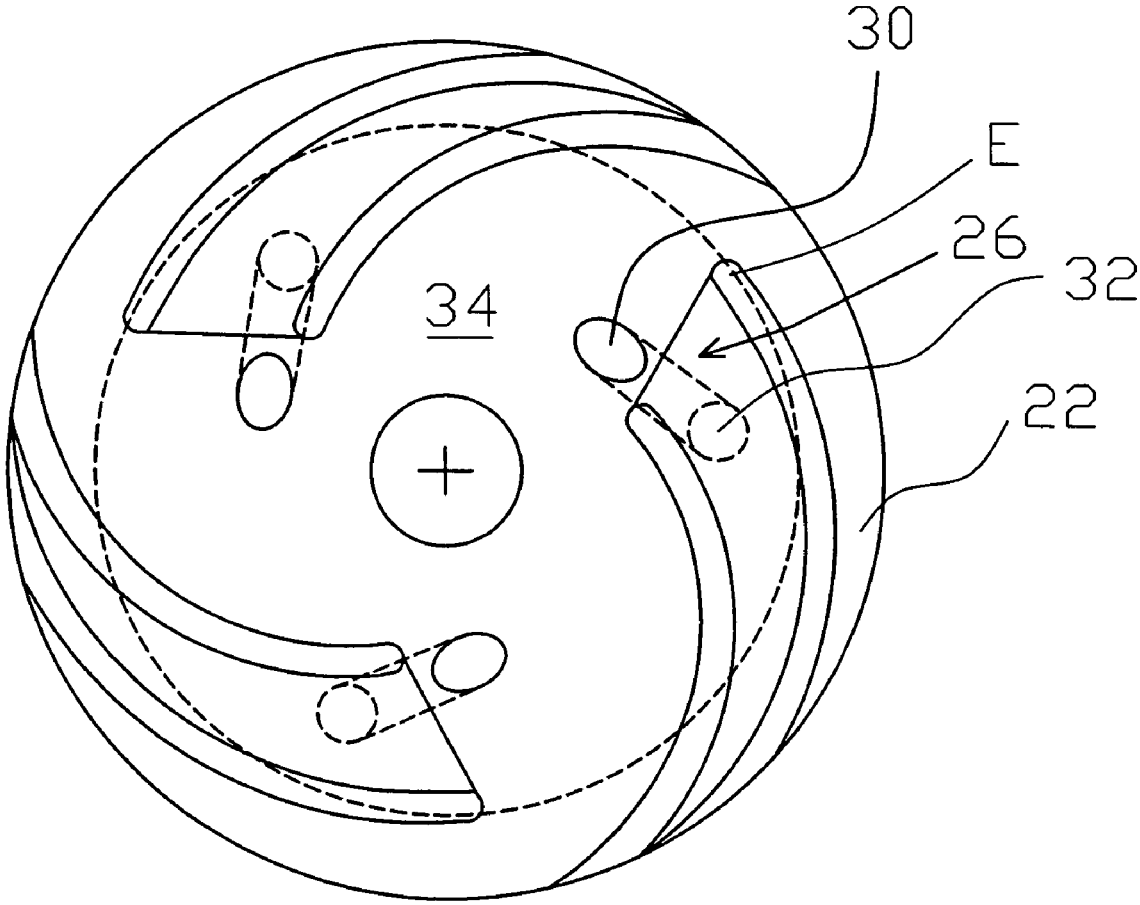
FIG. 4 schematically illustrates a front view of an impeller in accordance with a second preferred embodiment of the invention seen from the direction of the suction conduit.

FIG. 4 illustrates a front view of an impeller in accordance with FIG. 3. The drawing illustrates with broken lines the location of the balancing holes 26 in the impeller shroud 22 and in the impeller vane passages 34. The drawing shows that the balancing hole 26 runs circumferentially inclined; i.e. each hole is turned towards its own impeller vane passage 34. Thus, each balancing hole is inclined both in the peripheral and radially outward directions from the opening 30 in the front face of the impeller shroud. The aim with the balancing hole 26 extending through the impeller shroud 22 at least substantially in the direction of the impeller vane passage 34 is on the one hand that the speed of the liquid flowing via the hole 26 to the rear vane area is in the right direction so that less work is required from the rear vanes to pump the flowing liquid out of the space behind the impeller 20. On the other hand, the aim is to increase the flow of the liquid through the balancing holes 26 to the rear vane area so that the pressure in the sealing space S would remain positive throughout the entire capacity range of the pump.

The above description discusses very generally balancing holes and their direction. It should be noted about the holes that they may vary a lot, for example, in shape. In other words, all round, oval and angular shapes may come into question. The cross-sectional area of the holes may either be constant throughout the whole length of the hole or it may vary at least for a portion of the length of the hole. Further, it must be noted that both in the description above and in the accompanying claims, the direction of the hole refers more to the direction of the centerline or axis of the hole than to the direction of any specific wall thereof.

As can be seen from the above description, a new impeller has been developed, eliminating disadvantages of the prior art impellers. An impeller in accordance with the invention enables the use of the pump also at capacities higher than that of the optimal operating point, without a risk of damaging seals. While the invention has been herein described by way of examples in connection with what are at present considered to be the preferred embodiments, it is to be understood that the invention is not limited to the disclosed embodiments, but is intended to cover various combinations and/or modifications of its features and other applications within the scope of the invention as defined in the appended claims.

The invention claimed is:

1. A centrifugal pump, comprising a pump volute, a rear wall of said pump, a pump shaft, an impeller having a shroud, working vanes arranged on the front surface thereof, leaving impeller vane passages therebetween, and balancing holes extending through said shroud, said impeller being attached to the pump shaft and rotating inside said volute, said impeller having balancing holes located in the impeller shroud in such a way that openings of said holes in the front face of the impeller shroud are located both in the rotational direction of the impeller and ahead of an opening located in the rear face of the impeller shroud and closer to the axis of the pump and the impeller than the opening in the rear face of the impeller shroud.

2. The centrifugal pump in accordance with claim 1, wherein the balancing hole openings in the rear face of the impeller shroud, when compared to the balancing hole openings in the front face of said impeller, are located circumferentially in such a way that the direction of the balancing holes, when looking at the impeller from in front thereof, is substantially the direction of the impeller vane passages.

3. The centrifugal pump in accordance with claim 1, wherein the balancing hole openings in the front face of the impeller shroud are located within a circle, which is formed by the radially inner tips E of the free edges of the working vanes while the impeller is rotating.

4. The centrifugal pump in accordance with claim 1, wherein the balancing hole openings in the front face of the impeller shroud are located substantially on a circle, from which the working vanes on the impeller shroud begin.

5. The centrifugal pump in accordance with claim 1, wherein the balancing hole openings in the front face of the impeller are located within a circle of revolution on the impeller shroud formed by the starting edge of the working vanes.

6. An impeller of a centrifugal pump, comprising at least a shroud, working vanes arranged on the front surface thereof, leaving impeller vane passages therebetween, and balancing holes extending through said shroud, wherein said balancing holes are located in the impeller shroud in such a way that the openings of the balancing holes in the front face of the shroud are located both in the rotational direction of the impeller and ahead of openings of the balancing holes in the rear face of the shroud and closer to the axis of the impeller than the opening in the rear face of the impeller shroud.

7. The impeller in accordance with claim 6, wherein the balancing hole openings in the rear face of the impeller shroud are located relative to the openings in the front face of the impeller shroud in the circumferential direction such that the direction of the balancing holes, as seen from in front of the impeller, is substantially the direction of the impeller vane passages.

8. The impeller in accordance with claim 6, wherein the balancing hole openings in the front face of the impeller shroud are located within a circle, which is formed by the inner tips E of the free edges of the working vanes while the impeller is rotating.

9. The impeller in accordance with claim 6, wherein the balancing hole openings in the front face of the impeller shroud are located substantially at a circle, from which the working vanes on the impeller shroud begin.

10. The impeller in accordance with claim 6, wherein the balancing hole openings in the front face of the impeller shroud are located within a circle, from which the working vanes on the impeller shroud begin.

* * * * *